US006220307B1

(12) United States Patent
Griffith

(10) Patent No.: US 6,220,307 B1
(45) Date of Patent: Apr. 24, 2001

(54) GRIPPER AXMINSTER LOOM WITH TUFT YARN SELECTION MECHANISM

(75) Inventor: John D. Griffith, Cleddon (GB)

(73) Assignee: Griffith Textile Machines Limited, Sunderland (GB)

( * ) Notice: Subject to any disclaimer, the term of this patent is extended or adjusted under 35 U.S.C. 154(b) by 0 days.

(21) Appl. No.: 09/489,114

(22) Filed: Jan. 21, 2000

(30) Foreign Application Priority Data

Jan. 22, 1999 (GB) ..... 9901358

(51) Int. Cl.[7] ..... D03D 39/08

(52) U.S. Cl. ..... 139/7 A; 139/7 D; 139/453; 66/207

(58) Field of Search ..... 139/453, 7 A, 139/7 D; 66/207

(56) References Cited

U.S. PATENT DOCUMENTS 5,400,834 * 3/1995 Lewyllie et al. ..... 139/453
5,502,987 * 4/1996 Zorini ..... 66/207
5,743,306 * 4/1998 Stewart et al. ..... 139/7 A

FOREIGN PATENT DOCUMENTS

0785301 B1 12/1996 (EP) .

* cited by examiner

*Primary Examiner*—Andy Falik
(74) *Attorney, Agent, or Firm*—Nikolai, Mersereau & Dietz, P.A.

(57) ABSTRACT

A mechanism for a gripper Axminster loom is disclosed which includes a plurality of yarn carriers each of which is movable to any one of a plurality of predetermined positions. Each carrier guides a plurality of tuft yarn and is arranged to present one of the yarns to a gripper when the carrier is located at a corresponding one of the predetermined positions. The mechanism includes a plurality of independently controllable rotary drive motors, each of which is connected to drive an associated carrier for selectively moving the associated carrier to a selected one of the predetermined positions.

11 Claims, 3 Drawing Sheets

GRIPPER AXMINSTER LOOM WITH TUFT YARN SELECTION MECHANISM

BACKGROUND OF THE INVENTION

1. Field of the Invention

The present invention relates to a tuft yarn selection mechanism and in particular, but not exclusively, an axminster loom incorporating such a selection mechanism.

2. Related Art

When weaving on a typical gripper axminster loom the carpet normally has three weft yarns per tuft loop (three shot carpet) whereas carpet woven on other types of loom usually have two weft yarns per tuft loop (two shot carpet).

The weft yarns are inserted in succession and so a 50% increase in carpet production can be achieved on an axminster loom if two weft yarns could be inserted without loss of insertion speed.

With a conventional axminster loom the speed of operation of the tuft yarn selection mechanism is too slow to enable correct selection of tuft yarns to be achieved for a two shot operation.

A general aim of the present invention is to provide a tuft yarn selection mechanism which operates at a sufficiently high speed to enable a twoshot carpet to be produced on gripper axminster loom without loss of insertion speed.

SUMMARY OF THE INVENTION

According to one aspect of the present invention there is provided a tuft yarn selection mechanism for a gripper axminster loom, the mechanism including a plurality of yarn carriers each of which is movable to any one of a plurality of predetermined positions, each carrier guiding a plurality of tuft yarns and being arranged to present one of said yarns to a gripper when the carrier is located at a corresponding one of said predetermined positions, and a plurality of independently controllable rotary drive motors, each drive motor being drivingly connected to an associated carrier for selectively moving the associated carrier to a selected one of said predetermined positions.

Preferably, each motor is an electric motor and is electrically controlled to move the associated carrier to said selected one of said predetermined positions.

Preferably the electric motor is a stepper motor.

Preferably each carrier has associated therewith sensing means for determining the position of the carrier and providing a signal indicative of the carrier being located at a selected one of said predetermined positions.

The sensing means may be used to determine arrival of the carrier at a selected one of said positions and thereby provide a signal to control stopping of the motor. Alternatively, electronic control means may be provided which transmit to the stepper motor a sufficient number of pulses to move the carrier from one position to the selected position, the sensor being arranged to confirm correct positioning of the carrier. In the event that the carrier is not correctly positioned (eg. it has overshot slightly), the sensor is used to provide a signal which is utilised by the electronic control means to correctively re-adjust the position of the carrier.

Preferably the yarn carriers are elongate and arranged to move longitudinally between said predetermined positions.

According to another aspect of the present invention there is provided a mechanism for a gripper axminster loom, the mechanism including a plurality of yarn carriers each of which is movable to any one of a plurality of predetermined positions, each carrier guiding a plurality of tuft yarn and being arranged to present one of said yarns to a gripper when the carrier is located at a corresponding one of said predetermined positions, and a plurality of independently controllable drive motors, each drive motor being drivingly connected to an associated carrier for selectively moving the associated carrier to a selected one of said predetermined positions, each drive motor being removably mounted to enable the drive motor to be disconnected from said associated carrier.

According to another aspect of the present invention there is provided a mechanism for a gripper axminster loom, the mechanism including a plurality of yarn carriers each of which is movable to any one of a plurality of predetermined positions, each carrier guiding a plurality of tuft yarn and being arranged to present one of said yarns to a gripper when the carrier is located at a corresponding one of said predetermined positions, and a plurality of independently controllable drive motors, each drive motor being drivingly connected to an associated carrier for selectively moving the associated carrier to a selected one of said predetermined positions, monitoring means for each carrier arranged to provide a signal indicative of the position of the associated carrier, and control means responsive to said signal in order to independently control the motor associated with each carrier.

Preferably the electric motors are arranged in groups, the motors of each group being mounted upon a common support.

According to another aspect of the present invention there is provided a gripper axminster loom adapted to weave a two-shot carpet.

BRIEF DESCRIPTION OF THE DRAWINGS

Various aspects of the present invention are hereinafter described with reference to the accompanying drawings, in which.

DETAILED DESCRIPTION

Figure 1:
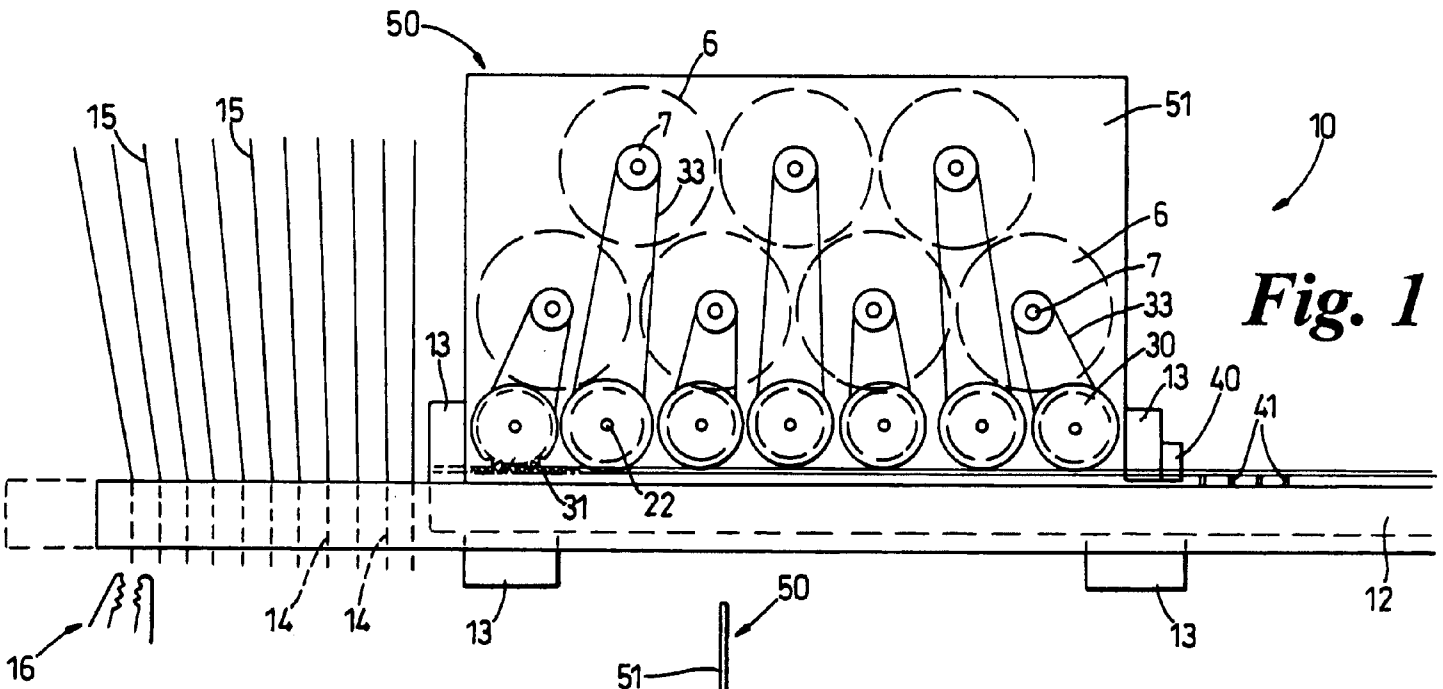
FIG. 1 is a side view of a first embodiment according to the present invention.
Figure 2:
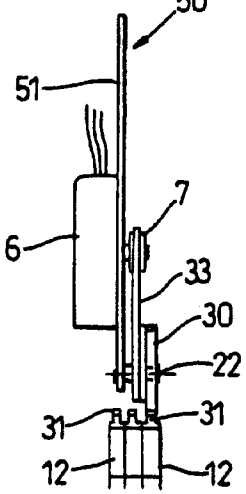
FIG. 2 is an end view of the first embodiment shown in FIG. 1.

A tuft yarn selection mechanism 10 according to a first embodiment shown in FIGS. 1 and 2 and includes a plurality of elongate tuft yarn carriers 12. Each carrier 12 is provided with a plurality of yarn guides 14 to which tuft forming yarns 15 are fed.

The yarn guides 14 are spaced from one another along the length of the carrier 12 and the carrier 12 is slidably mounted in guide blocks 13 for longitudinal movement such that any one of the yarn guides 14 can be moved into registry with a gripper 16.

The gripper 16 draws yarn 15 from a guide 14 which has been presented thereto in order to form a tuft in a known manner.

As is conventional, there is a gripper 16 for each tuft site in the loom and a yarn carrier 12 for each gripper 16.

Accordingly across the width of the loom, there is provided a large number of yarn carriers 12 which are arranged side by side and are closely spaced. This is illustrated, in a representative manner, in FIG. 2.

Each yarn carrier 12 is moved longitudinally by an individual rotary drive motor 6 to any one of a plurality of predetermined longitudinal positions each of which corresponds to a guide 14 being in registry with the associated gripper 16.

Preferably each drive motor 6 is arranged to drive a pinion gear 30 which meshes with a rack 31 on the associated yarn carrier 12. In FIG. 1, the motor 6 is preferably drivingly connected to its associated pinion gear 30 by a timing belt 33 and pulley 7.

Preferably a sensor 40 is provided which senses the presence of individual markers 41 which correspond in number to the number of yarn guides 14. The markers 41 are spaced along the length of the carrier 12 by the same spacing as guides 14 and so provide an indication as to the position of guides 14.

Electronic control means (not shown) are provided which control each motor 6 in order to move its associated carrier 12 in the desired direction and by the desired distance in order to move a selected yarn guide 14 into registry with the gripper 16.

Preferably the sensor 40 acts to provide a signal which is indicative of the carrier 12 arriving at a desired position, the signal being utilised by the control means to stop movement of the carrier 12 by arresting the motor 6. The motor 6 then acts to temporarily hold the carrier 12 at its selected position.

The motor 6 may be a stepper motor. In such a case, the control means may act to supply a predetermined number of pulses to the stepper motor in order to move the carrier 12 from one position to another position. The sensor 40 may then be utilised to confirm that the carrier 12 is correctly positioned, and if not, enable the control means to correct positioning of the carrier.

Conveniently the markers 41 are defined by slots formed in the carrier 12 and preferably the sensor 40 comprises an optical sensor which is capable of sensing the presence of the slots.

Preferably the motors 6 and associated pinion gears 30 are arranged in groups with all motors 6 and pinion gears 30 of each group being mounted on a common support 50, preferably in the form of a plate 51 which is removably mounted on the loom frame.

This has the advantage of enabling a faulty motor 6 to be quickly removed and replaced by removal of a plate 51 having the faulty motor 6 and replacement by a new plate 51. With such an arrangement, the replacement of a motor 6 may be carried out without moving the carriers 12 and disturbing yarns 15.

As seen in FIG. 1, the pinion gears 30 are spaced apart in the longitudinal direction of the carriers 12 and the plate 51 is preferably mounted so as to extend at an inclined angle laterally relative to the carriers 12 such that adjacent pinion gears 30 may engage with the racks of adjacent carriers 12.

If the shafts 22 on which the pinion gears 30 are mounted project perpendicularly from the plate 51, the gears 30 will have an axis of rotation which is not perpendicular to the longitudinal axis of the rack on associate carrier 12. This misalignment can be accommodated by the provision of suitable gear teeth on the pinion gear and/or rack.

Alternatively, the shafts 22 of the pinion gears 30 may be mounted so as to project from the plate 51 at an acute angle so as to ensure that the axis of rotation of each pinion gear is perpendicular to the longitudinal axis of the rack.

The motors 6 are preferably arranged in two rows extending parallel to the longitudinal direction of the carriers.

With this arrangement, it is possible to accommodate relatively large motors 6 for driving closely spaced carriers 12. It will be appreciated that, in each group of motors 6, the motors 6 may be arranged in one row or in more than two rows.

Figure 3:
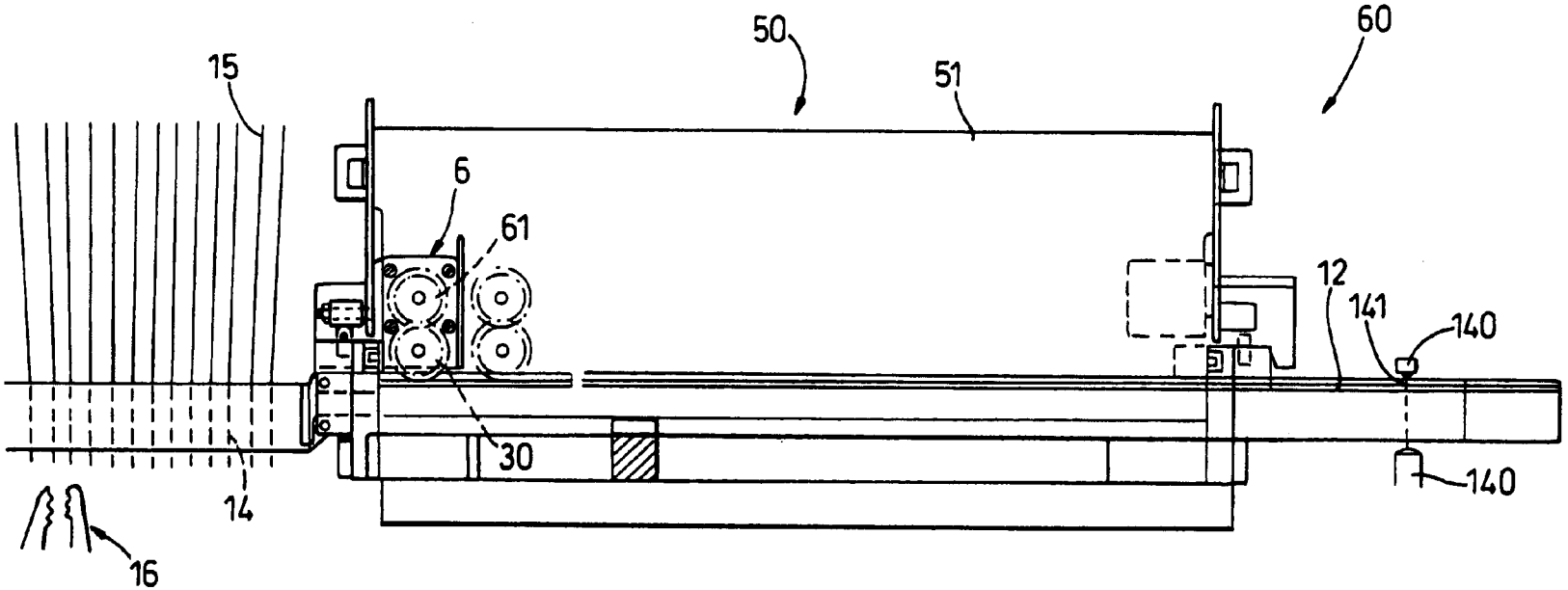
FIG. 3 is a side view of a second embodiment according to the present invention.
Figure 4:
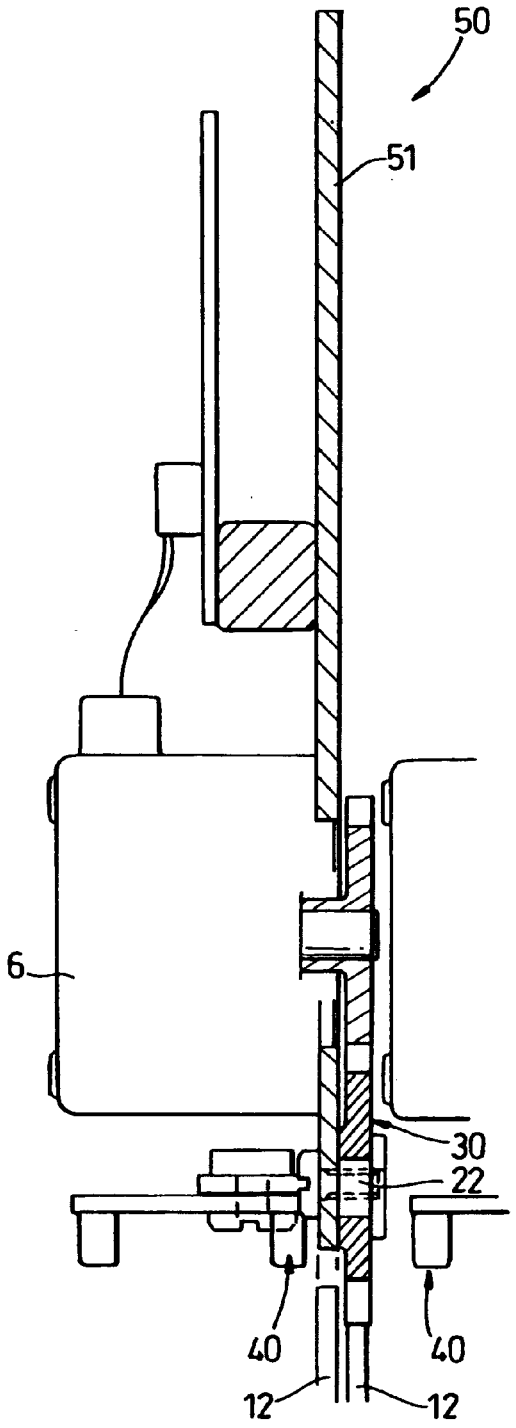
FIG. 4 is an end view of the second embodiment.
Figure 5:
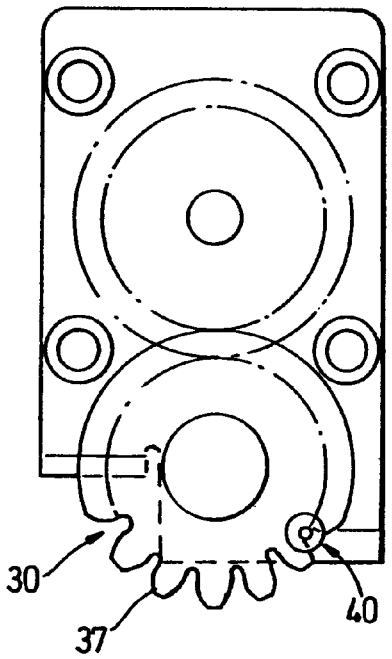
FIG. 5 is an enlarged view of a motor and pinion gear shown in FIG. 3

A second embodiment 60 is illustrated in FIGS. 3 to 5, wherein parts similar to those in the first embodiment are referenced by the same reference numerals In embodiment 60, each motor 6 is arranged to directly drive an associated pinion gear 30 via a drive gear 61. Accordingly in the second embodiment, all motors 6 carried by the common support plate 51 are arranged in one row. The plate 51 is inclined across adjacent carriers 12 to enable individual pinion gears 30 to mesh with an associated carrier.

In embodiment 60, sensor 40 for sensing the position of the associated carrier has been repositioned to co-operate with the teeth 37 of the associated pinion gear 30. In this respect the sensor 40 is preferably an optical sensor which is arranged to detect the spaces between the pinion teeth 37 as the pinion gear rotates.

Accordingly, in embodiment 60, markers 41 on each carrier 12 have been dispensed with.

Optionally, a further sensor 140 may be provided for co-operating with a marker 141 on each carrier 12. The marker 141 is positioned along the carrier to indicate a desired reference position, preferably a mid-way position in the travel of the carrier 12. This enables each carrier to be moved to the reference position and enables calibration of sensors 40 to be achieved.

In addition, if desired, the provision of sensor 140 in combination with marker 141 enables each carrier 12 to be moved to its mid-position prior to being moved to the next selected position of the carrier for delivering a desired yarn to the associated tuft gripper.

In the above embodiments, motors 6 are electrically powered. It will be appreciated that they may be fluid powered in which case the control means would be arranged to control flow of fluid to the motors in order to control movement of the carriers.

It will be appreciated that the carriers 12 are moved by motors which act independently of one another and independently of the main drive shaft of the loom.

It will be appreciated that by appropriate control from the control means, each carrier 12 can be individually controlled to move from one position to another selected position at any desired time within the weaving cycle and at any desired speed. It is therefore possible with the present invention to quickly and accurately position the carriers 12 in a gripper axminster loom to enable two-shot carpet to be produced.

What is claimed is:

1. A gripper Axminster loom including a tuft yarn selection mechanism, the mechanism including:

(a) a plurality of tuft yarn carriers each of which is moveable to any one of a plurality of predetermined positions;

(b) each carrier having a plurality of yarn guides which are spaced from one another for guiding a plurality of tuft yarns and being arranged to present a selected one of said yarns into registry with a gripper when the carrier is located at a corresponding one of said predetermined positions;

(c) a plurality of independently controllable rotary drive motors, each drive motor being drivingly connected to an associated carrier to cause movement of said associated carrier; and (d) an electronic control system operable to selectively operate each motor to move an associated carrier to a selected one of said predetermined positions and operate said motor to temporarily hold said associated carrier at said selected one position.

2. A loom according to claim 1 wherein each motor is an electric motor and is electrically controlled to move the associated carrier to said selected one of said predetermined positions.

3. A loom according to claim 2 wherein each motor is mounted on a removable support to enable the motor to be disconnected from said associated carrier.

4. A loom according to claim 2 wherein each motor is a stepper motor.

5. A loom according to claim 4 wherein each motor is mounted on a removable support to enable the motor to be disconnected from said associated carrier.

6. A loom according to claim 1 wherein each motor is mounted on a removable support to enable the motor to be disconnected from said associated carrier.

7. A loom according to any one of claims 1 and 2–5 wherein the motors are arranged in groups, the motor s in each group being mounted on a common removably mounted support.

8. A loom according to any of claims 1 and 2–5 wherein each carrier has associated therewith sensing means for determining the position of the carrier and providing a signal indicative of the carrier being located at a selected one of said predetermined positions.

9. A loom according to one of claim 5 wherein each drive motor includes a stepper mechanism that acts to hold its associated carrier at said selected one of said predetermined positions.

10. A gripper Axminster loom including a tuft yarn selection mechanism, the mechanism including:

(a) a plurality of tuft yarn carriers each of which is moveable to any one of a plurality of predetermined positions;

(b) each carrier having a plurality of yarn guides which are spaced from one another for guiding a plurality of tuft yarns and being arranged to present a selected one of said yarns into registry with a gripper when the carrier is located at a corresponding one of said predetermined positions;

(c) a plurality of independently controllable drive motors, each drive motor being drivingly connected to an associated carrier to cause movement of said associated carrier;

(d) an electronic control system operable to selectively operate each motor to move an associated carrier to a selected one of said predetermined positions and operate said motor to temporarily hold said associated carrier at selected one position; and (e) wherein each drive motor is removably mounted to enable the drive motor to be disconnected from said associated carrier.

11. A gripper Axminster loom including a tuft yarn selection mechanism, the mechanism including:

(a) a plurality of tuft yarn carriers each of which is moveable to any one of a plurality of predetermined positions;

(b) each carrier having a plurality of yarn guides which are spaced from one another for guiding a plurality of tuft yarns and being arranged to present a selected one of said yarns into registry with a gripper when the carrier is located at a corresponding one of said predetermined positions;

(c) a plurality of independently controllable drive motors, each drive motor being drivingly connected to an associated carrier to cause movement of said associated carrier; and (d) an electronic control system operable to selectively operate each motor to move an associated carrier to a selected one of said predetermined positions and operate said motor to temporarily hold said associated carrier at said selected one position, and;

(e) monitoring means for each carrier arranged to provide a signal to said control means indicative of the position of the associated carrier.

* * * * *